US005082461A

United States Patent [19]

Minnis et al.

[11] Patent Number: 5,082,461

[45] Date of Patent: Jan. 21, 1992

[54] WIRE TO PIN TERMINATION

[75] Inventors: Alan J. Minnis, London; Michael J. G. Whelan, Hitchon, both of England

[73] Assignee: AMP Incorporated, Harrisburg, Pa.

[21] Appl. No.: 606,008

[22] Filed: Oct. 30, 1990

[30] Foreign Application Priority Data

Oct. 30, 1989 [GB] United Kingdom ..... 8924358

[51] Int. Cl.[5] ..... H01R 4/48

[52] U.S. Cl. ..... 439/786; 439/888

[58] Field of Search ..... 439/49, 435, 442, 708, 439/792, 786, 863, 877, 888; 174/90, 94 R, 94 S

[56] References Cited

U.S. PATENT DOCUMENTS 3,243,757 1/1964 Cobaugh ..... 439/442
3,251,022 5/1966 Hammell ..... 439/442
3,273,102 9/1966 Cobaugh ..... 439/49
3,697,669 10/1972 O'Louglin ..... 174/90
4,087,149 5/1978 Fischer ..... 439/435

*Primary Examiner*—Neil Abrams
*Attorney, Agent, or Firm*—Bruce J. Wolstoncroft; William B. Noll

[57] ABSTRACT

A terminal clip (2) for holding a conductor (30) against and in electrical contact with a terminal post (32) has a conductor receiving section (4) and mounting sections (6,8). The conductor receiving section (4) has a channel (24) provided therein. The channel (24) has a varied cross-sectional configuration to cooperate and maintain the conductor (30) in position. The mounting sections (6,8) have arcuate, resilient sections (14), which deform within their elastic limits as the clip (2) is inserted onto the post (32). This allows the clip (2) to compensate for dimensional variations, and to generate the normal force required to maintain the conductors (30) and the post (32) in electrical engagement.

8 Claims, 4 Drawing Sheets

WIRE TO PIN TERMINATION

FIELD OF THE INVENTION

This invention relates to electrical connections between conductors and terminal posts and to the terminal clips for making such connections. The invention is particularly directed to improved terminal clips which are effective under high temperature, high current conditions.

BACKGROUND OF THE INVENTION

A common method of making electrical connections is to provide a terminal post to which a conductor may be connected by any one of several preexisting methods. For example, in the wiring of complex electronic circuits for computers or other relatively complex devices, panel boards are frequently used having a multiplicity of terminal posts mounted thereon in accordance with a coordinate grid system. The wiring pattern for the device is then achieved by electrically connecting selected posts by means of suitable conductors. In accordance with prior art practice the individual conductors may be connected to the individual posts by, for example, soldering, by welding, and by wrap type connections in which the end of the conductor is wrapped around the post.

Terminal posts are also frequently used for less complex electrical devices such as motors, relays, automotive and aircraft equipment, and appliances. Many different sizes of posts are used although in a given piece of equipment, it is common to use one size for all connections.

U.S. Pat. No. 3,243,757 discloses a termination which consists of a wire, solid or stranded, connected to a rectangular post by means of a clip and retained under sustained pressure. Mechanical energy is stored in the clip in the form of elastic stresses which are generated when the clip and wire are applied to the post. In essence, it is a compressed spring which maintains a continual force between the wire and post.

This type of clip is useful in many situations, however several problems exist. When the wire is connected to the post, the wire must be stripped of insulation, preformed and applied to the post under the clip. It would prove beneficial if, during the application of the clip and wire, no material forming were required. Another problem associated with the prior art clip relates to its reliability in harsh conditions. Due to the configuration of the clip, the clip may deform in the plastic region, thereby causing the normal force to be insufficient to accommodate for the dimensional variations imposed by manufacturing tolerances and thermal cycling. It would therefore, prove beneficial to have an improved clip which, when subjected to extreme conditions, would deform only in the elastic range.

SUMMARY OF THE INVENTION

The invention is directed to a terminal clip for holding a conductor against, and in electrical contact with a terminal post. The terminal clip has a conductor receiving section for receipt of the conductor therein and mounting sections which cooperate with the terminal post.

The conductor receiving section has a channel provided therein. The channel has a varied crosssectional configuration across the length of the conductor receiving section, such that the channel cooperates with the conductor to insure that the conductor is precisely positioned in the channel.

The mounting sections have an arcuate, resilient section, the configuration of which insures that when the section will deform within its elastic limit. Whereby as the clip is exposed to various environments, the clip will compensate for dimensional variations, and generate an adequate normal force to maintain the conductor and the post in electrical engagement.

DETAILED DESCRIPTION OF THE INVENTION

Figure 1:
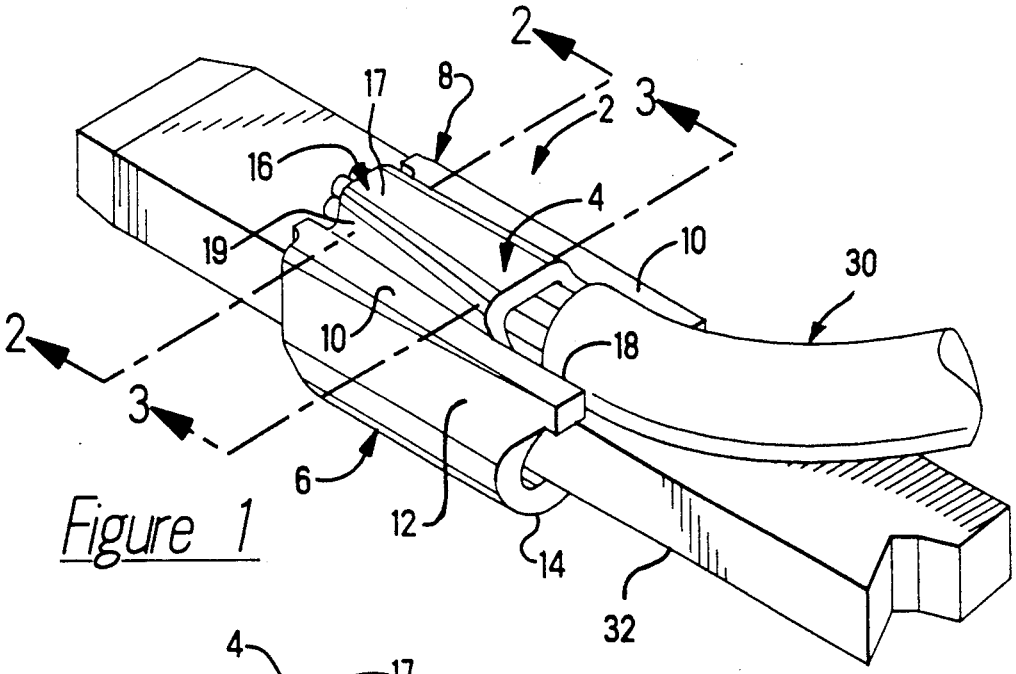
FIG. 1 is a perspective view of an electrical connection between a terminal post and a multistranded conductor in accordance with the present invention.
Figure 9:
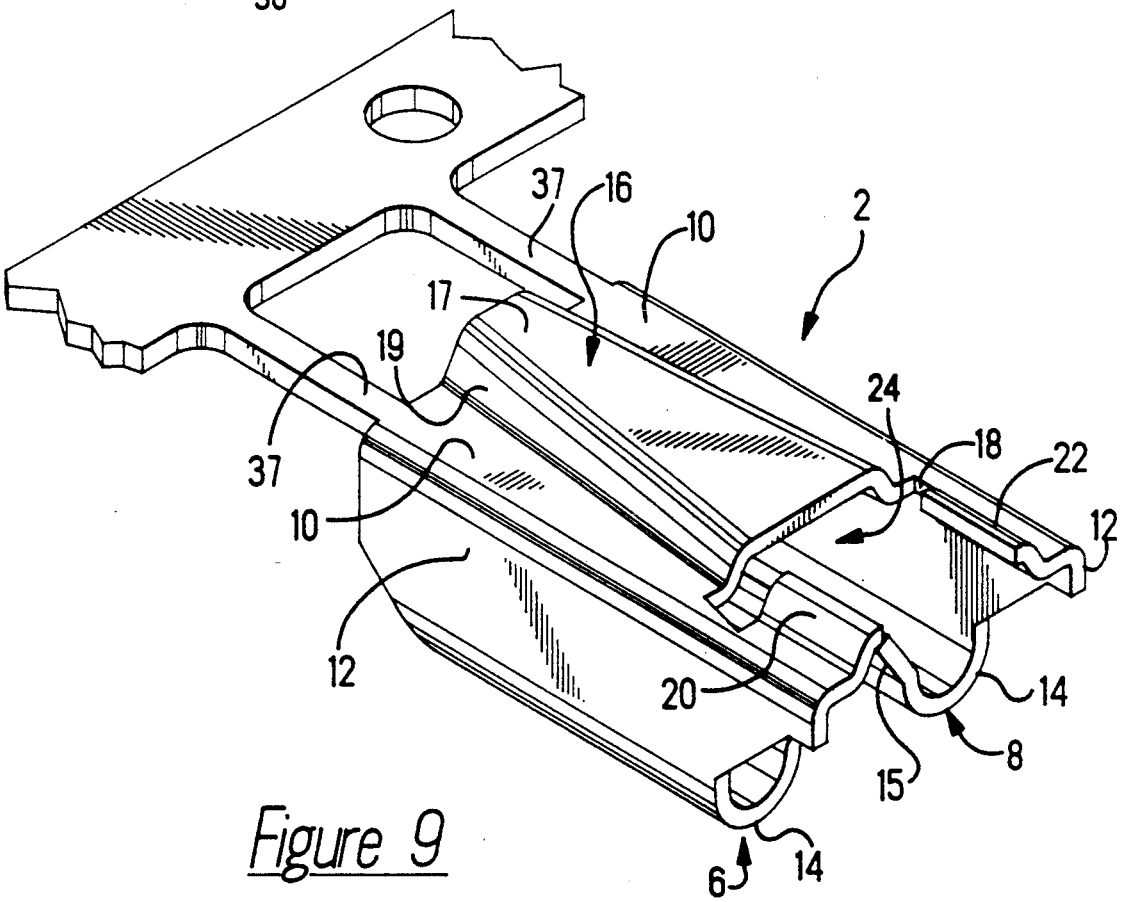
FIG. 9 is a perspective view of the clip attached to the carrier strip, a portion of the clip is broken away to show the mounting sections.

Referring to FIGS. 1 and 9, terminal clip 2 in accordance with the invention has a conductor receiving section 4 and mounting sections 6,8. The mounting sections 6,8 extend from either side of conductor receiving section 4.

Figure 2:
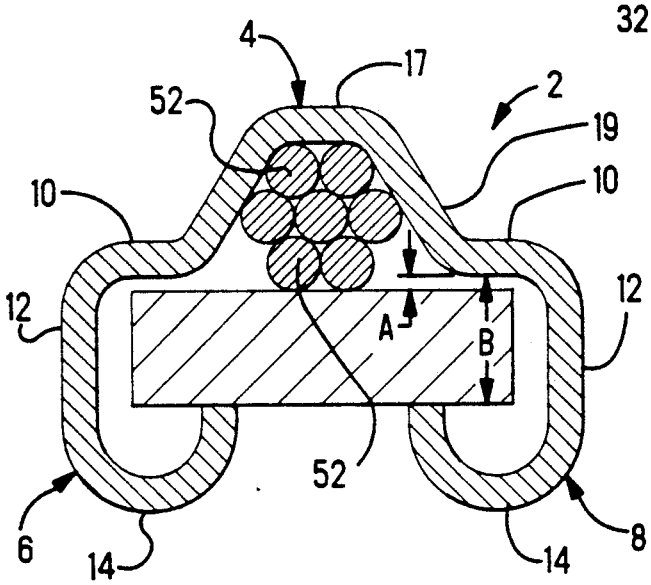
FIG. 2 is a cross-sectional view, taken along line 2—2 of FIG. 1, of a portion of the termination between the terminal post and the multistranded conductor.
Figure 3:
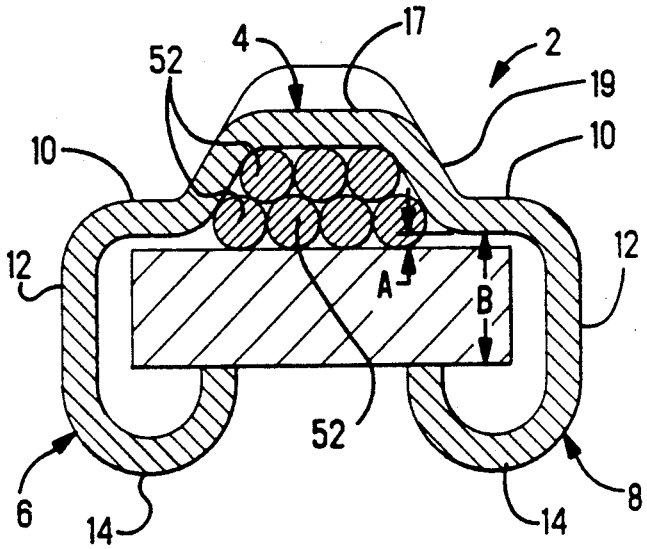
FIG. 3 is a cross-sectional view, taken along line 3—3 of FIG. 1, of a portion of the termination between the terminal post and the multistranded conductor.

As best illustrated in FIGS. 2 and 3, the mounting sections 6,8 have top walls 10 which are integrally attached to the conductor receiving section 4. Side walls 12 extend from top walls 10 in a direction which is essentially perpendicular to the top walls. Arcuate bottom walls 14 extend from side walls 12, such that free ends of the bottom walls extend toward top walls 10 in a direction which is essentially parallel to the side walls 12. The configuration of the bottom walls provides the resilient characteristics required in order to insure for the reliability of the clip, as will be more fully discussed. Lead-in surfaces 15, as shown in FIG. 9, are provided on the bottom walls 14 proximate a first end of the clip.

The conductor receiving section 4, as best shown in FIGS. 1 and 9, has an engagement portion 16 which cooperates with a conductor 30 to supply the normal force required to insure that the conductor 30 is maintained in electrical engagement with a post 32. As shown in FIGS. 1 and 9, the engagement portion 16 has a top wall 17 and side walls 19. The engagement portion has a type of inverted U-shaped configuration, which has a channel 24 extending proximate thereto. The top wall 17 is tapered such that the width of the channel 24 provided between the top wall 17 and side walls 19 is smaller proximate a second end of the clip 2 and larger proximate opening 18. The side walls 19 are also tapered, such that the height of the channel 24 is larger proximate the second end of the clip 2 and smaller proximate the opening 18. The engagement portion 16 of the conductor receiving section 4 extends for approximately half of the length of the clip 2.

The configuration of the engagement portion insures that an adequate normal force will be generated between the post 32 and the conductor 30, thereby insuring that a positive electrical connection will be effected and maintained, even in adverse conditions. The compound taper also insures that the conductor 30 will be maintained in position, even as external forces are applied thereto. In other words, the engagement portion also acts as a type of strain relief, as will be more fully discussed below.

The opening 18 is provided adjacent to the engagement portion 16, with the opening extending across the remaining length of the clip. It should be noted that the relative sizes of the engagement portion 16 and opening 18 can vary according to the desired characteristics of the clip 2. Extending from the top walls 10 of the mounting section 6,8 and into the opening 18 are insulation piercing members 20,22 as shown in FIG. 9. In the embodiment shown, the insulation piercing members 20,22 are positioned proximate the first end of the clip 2.

The terminal clips 2 are stamped and formed from material having the appropriate electrical and mechanical characteristics. In particular applications, the electrical characteristics must be substantial in order to withstand the requirements of operation in a continuous maximum ambient temperature of 250 degrees Celsius (not including temperature rise due to current) and carry up to 16A. In the embodiment shown, the clip is manufactured in stainless steel 301 S21 of a fully hard condition. This is an austenitic grade facilitating the increase yield stress by work hardening. It is also important to note that the clip is stamped and formed such that the grain direction of the material is perpendicular to the principle bend radii. This serves to optimize both manufacturability and design performance. To facilitate the handling of the clips, the clips are maintained on a carrier strip, as shown in FIGS. 8 and 9, until they are inserted onto respective posts 32.

Figure 6:
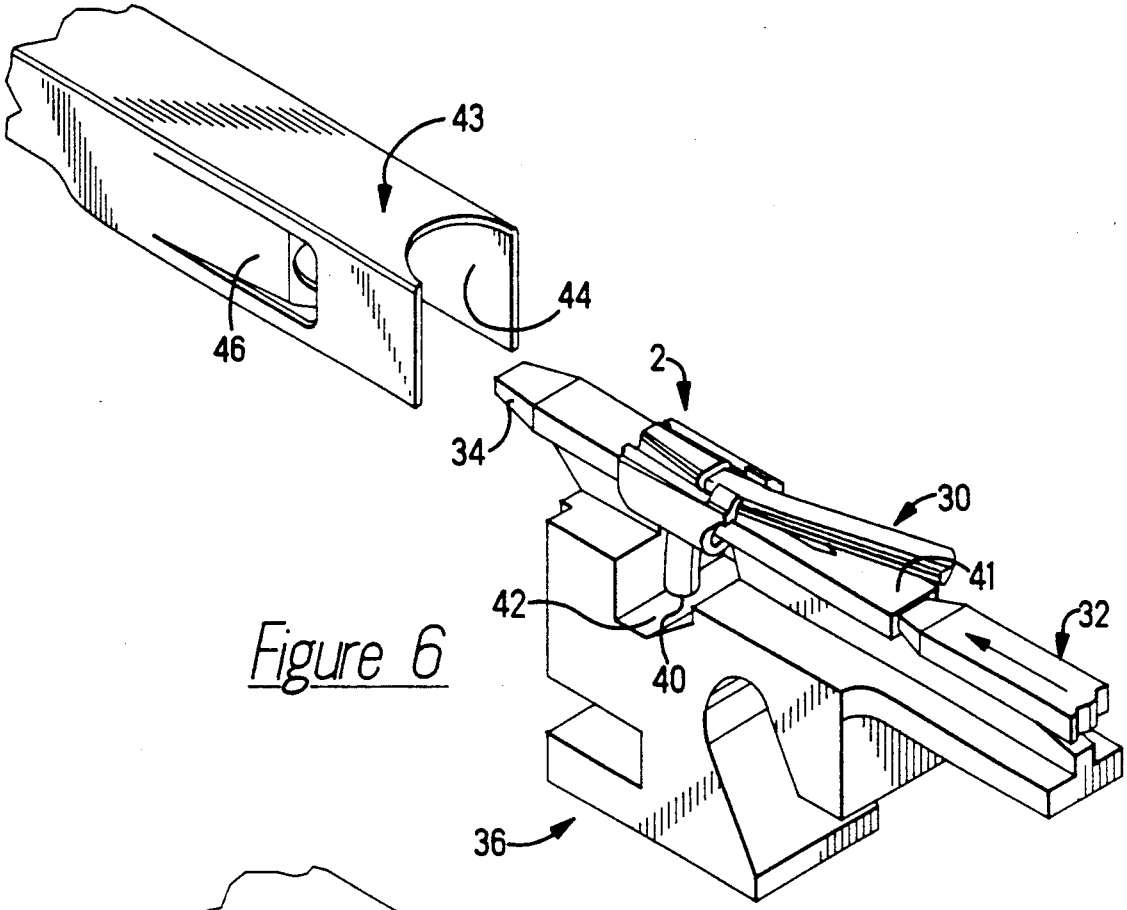
FIG. 6 is a perspective view of the portion of the insertion tool shown in FIG. 4, showing a mounting rod in a first position.
Figure 7:
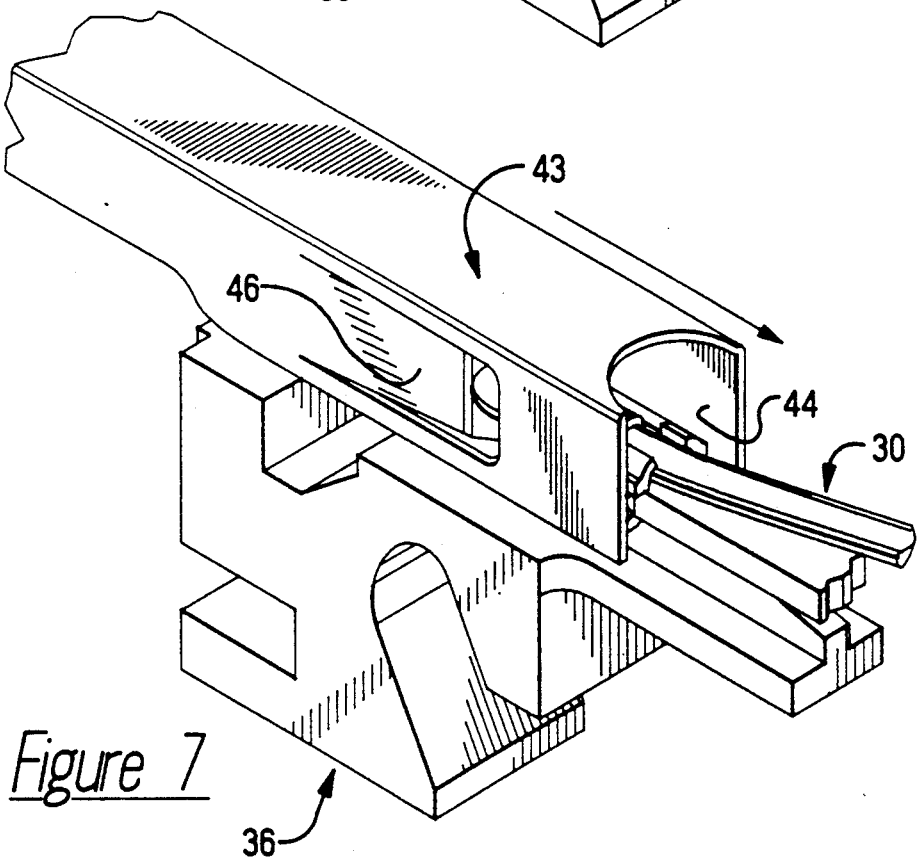
FIG. 7 is a perspective view similar to that of FIG. 6, showing the mounting rod in a second position, in which the clip is inserted onto the post.
Figure 8:
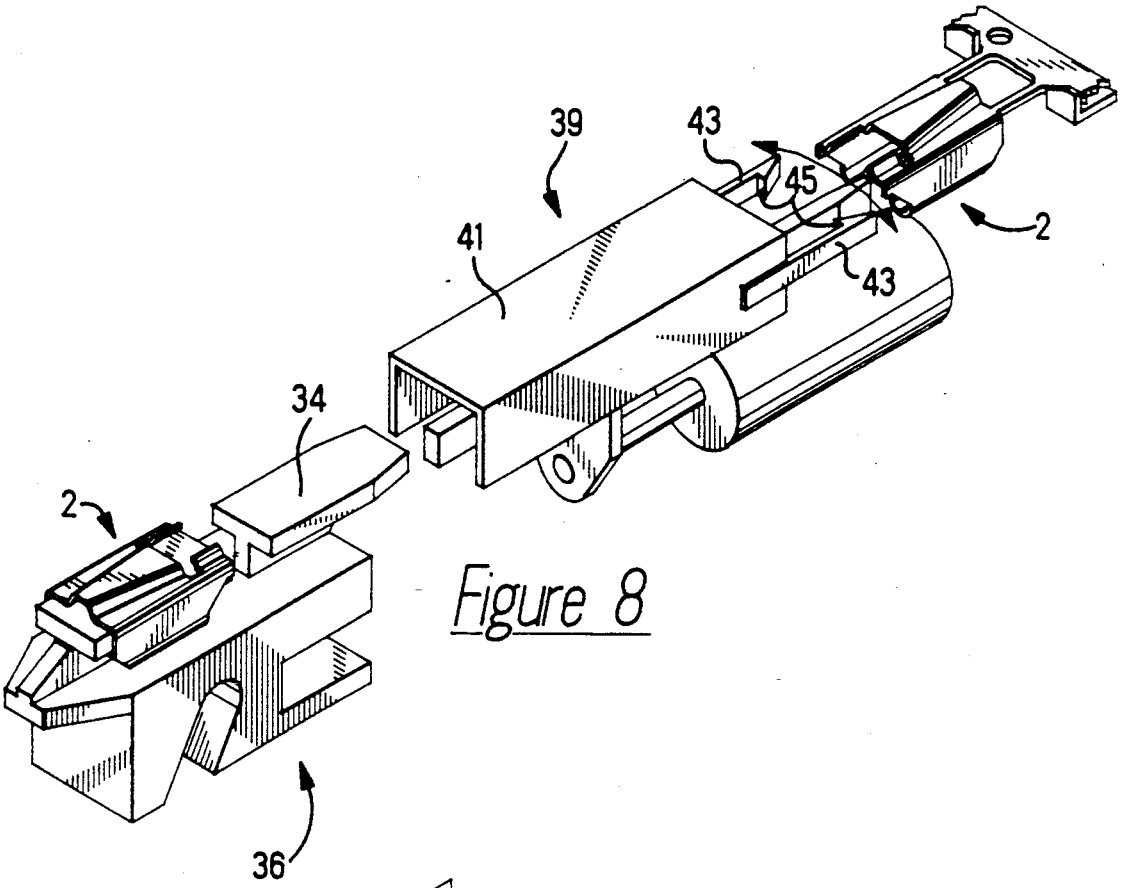
FIG. 8 is a perspective view of a linear cam which cooperates with the clip to remove the clip from the carrier strip and position on the portion of the insertion tool shown in FIG. 4.

In order to provide the electrical connection required between the conductor 30 and the post 32, an insertion-termination tool is utilized As shown in FIGS. 4 through 8, the clip 2 is positioned on a retention arm 34 of a mandrel 36. In order to position the clip on the retention arm, the clip 2 must be removed from the carrier strip. In order to facilitate the removal of the clip 2 from the carrier strip, the carrier strip is configured to have a weak joint 37 (FIG. 9) which will fail under minimal tensile stress. The cross-sectional area of the joint may be reduced by coining or some other manner in order to insure that the joint will fail as required. As shown in FIG. 8, a portion 39 of the insertion-termination tool can generate the forces required to remove the clip from the carrier strip. In order to facilitate the removal of the clip from the carrier strip, the tool incorporates a linear cam member 41 which is positioned proximate to the mandrel. Member 41 has spring loaded, pivotable arms 43 provided at one end thereof. As portion 39 is moved toward the carrier strip, arms 43 are deflected outward by the respective clip 2. As the advancement of the portion 39 is continued, the free ends of arms 43 are moved beyond the clip 2. The arms are therefore allowed to return to their unstressed position. In this position, shoulders 45 of arms 43 are adjacent the second end of the clip 2.

When arms 43 return to the unstressed position, the movement of portion 39 is reversed, causing portion 39 to move away form the carrier strip. As the shoulders 45 engage the clip 2, sufficient force is generated to remove the clip from the carrier strip. With the clip removed, portion 39 and clip 2 are moved toward mandrel 36. The movement continues until clip 2 is positioned on the retention arm 34 of mandrel 36. Once the clip 2 is properly positioned, the movement of the portion 39 is again reversed, such that portion 39 moves toward the carrier strip.

The upper and lower surfaces of the retention arm 34, as shown in FIG. 8, is tapered to allow for the easy insertion of the clip 2 onto the retention arm 34. The tapered surfaces also insure that the arcuate bottom walls 14 of the clip 2 will be forced into a stressed position when the clip is inserted onto the retention arm 34. This insures that the channel 24 will be large enough to accept the conductor 30 therein. Also, the use of the tapered surfaces provides for a slight interference fit between the retention arm 34 and the clip 2, thereby insuring that the clip 2 will be retained on the retention arm 34. It should be noted however, that the taper of the retention arm 34 should fall within specified limits. If the angle of taper is too great, the excessive opening of the clip, which will result, can cause the reduction of the strand surface abrasion of the conductor during termination, thereby reducing the reliability of the electrical connection.

Figure 4:
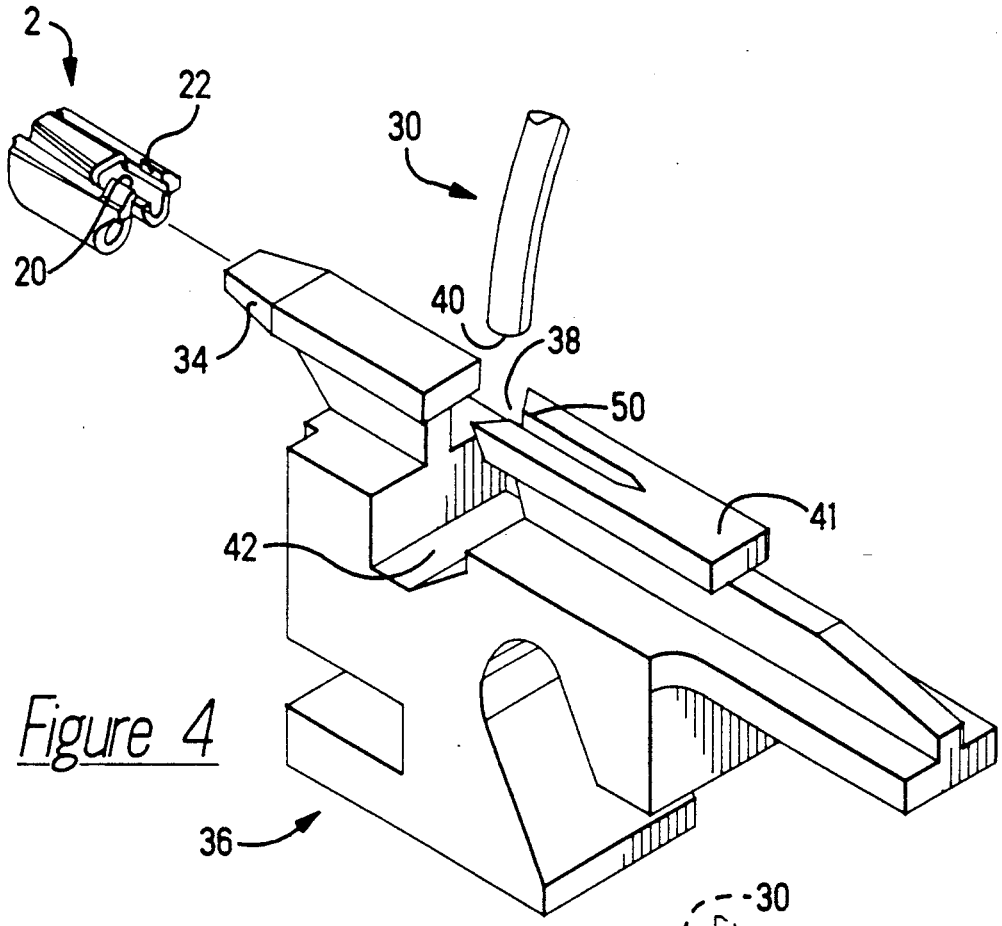
FIG. 4 is a perspective view of a portion of an insertion tool with a clip and the conductor shown just prior to engagement with the tool.
Figure 5A:
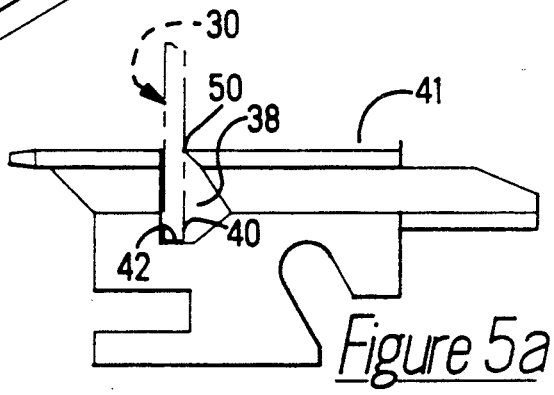
FIG. 5*a* is a side view of FIG. 5.
Figure 5:
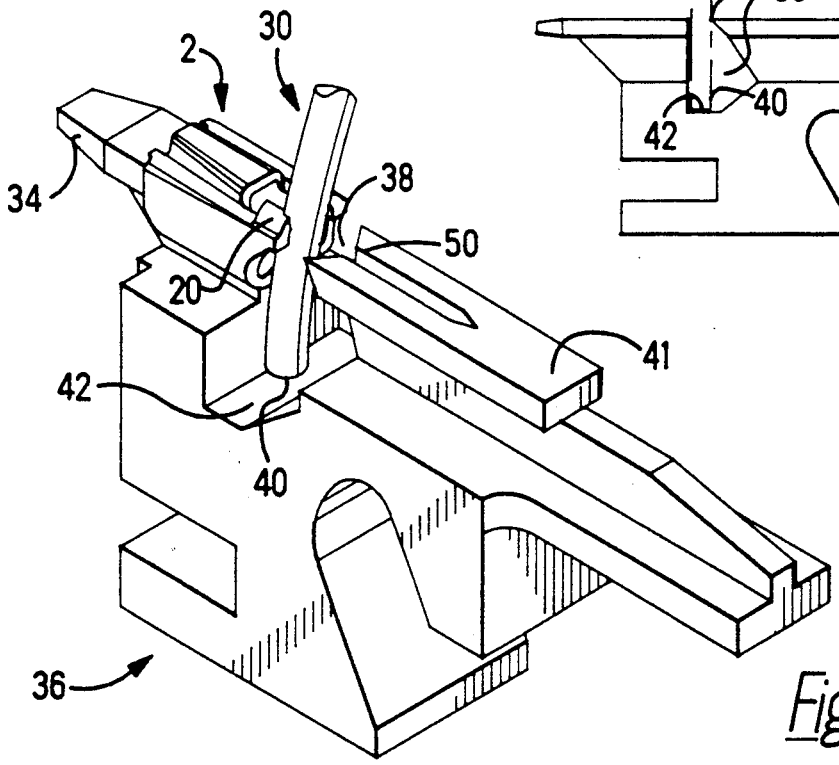
FIG. 5 is a perspective view similar to that of FIG. 4, showing the clip and the conductor in a first or preinserted position.

Once the clip 2 is properly positioned on the retention arm 34, the unstripped conductor 30 is inserted into an opening 38 of the mandrel 36, as best shown in FIG. 4. As illustrated in FIG. 5, the conductor 30 is fully inserted into the opening 38 when the free end 40 of the conductor 30 physically engages a bottom surface 42 of the opening 38. It is worth noting, that when the conductor is properly positioned, a portion of the conductor 30 is adjacent to the insulation piercing members 20,22 of the clip 2.

With the conductor 30 and clip 2 properly positioned, the post 32 is inserted in the direction of the arrow (FIG. 6) into a post receiving arm 41, as shown in FIGS. 6 and 7. The post receiving arm 41 is hollow to allow the post 32 to be inserted therethrough.

With the clip, conductor, and post properly positioned in the initial or first position, a mounting rod 43 is moved into cooperation with the various members. As best shown in FIGS. 6 and 7, the mounting rod 43 has a recess 44 provided therein. The recess 44 has slightly larger dimensions that clip 2, thereby allowing the clip 2 to be positioned in the recess 44 as the rod 43 is moved from the first position, shown in FIG. 6, to the second position, shown in FIG. 7.

As the mounting rod 43 is moved from the first position to the second position, engagement arms 46 of the mounting rod physically engage the mounting sections 6,8 of the clip 2, causing the mounting sections, and consequently the clips 2, to move in the same direction (the direction indicated by the arrow in FIG. 7) as the mounting rod 43. This causes the clip 2 and conductor 30 to be moved onto the post 32.

As the mounting rod 43 is moved from the first position to the second position, the free end portion of the conductor 30 is stripped of its insulation. The movement of the mounting rod causes the clip 2 to move across the mandrel 36. As the conductor 30 is perpendicular to the clip, the movement of the clip causes the conductor to be positioned against the stripping edge 50 (FIGS. 4 and 5) of the mandrel 36. Further linear motion of the clip 2 causes the insulation of the conductor 30 to be removed and the individual strands 52 of the conductor to form under the clip 2. Continued motion of the tool, pushes the clip 2 and strands 52 from the mandrel 36 onto the post 32. The insulation piercing members 20,22 facilitate the insulation stripping of the conductor 30 by laterally retaining the conductor 30 within clip 2. As the clip 2 moves across the conductor 30 during termination, the tapered configuration of the engagement portion 16 provides a funneling action which centralizes the conductor 30 therein. The edges of the insulation piercing members 20,22 penetrate the insulation of the conductor, thus aiding the stripping with the mandrel 36.

It is important to note that during the application of the clip 2 and conductor 30 to the post 32, no material forming occurs, other than the flattening of the conductor strands 52 and the elastic deformation of the clip 2, which will be more fully described below. This obviates the requirement for specific application tooling commonly found in the form of a crimper.

As the termination of the clip 2 and the conductor to the post 32 occurs, it is important to note several significant features. The lead-in surfaces 15 provided on the mounting sections 6,8 serve to aid insertion of the clip 2 on the post 32 by gradually increasing the normal force supplied by the clip 2. Consequently, the force required for insertion can be gradually increased as required.

The clip itself generates the normal force by elastic deformation. The elastic flexure, predominantly of the arcuate bottom walls 14 during and after termination, ensures that the normal force is generated in the elastic region, i.e. below the limit of proportionality, thereby without exceeding the yield stress. This fact allows the clip 2 to be receptive to the accommodation of dimensional variations imposed by manufacturing tolerances and thermal cycling, without reducing normal force below design minimum.

The elastic behavior eliminates the requirement for excessively tight manufacturing tolerances. Consequently, the dimension A, as shown in FIGS. 2 and 3, between the top walls 10 of the mounting sections 6,8 and a respective surface of the post 32, and therefore, the dimensions B between the free ends of the bottom walls 14 and the top walls 10 of the mounting sections 6,8 are not required to have the narrow tolerance limits which were required in the connectors of the prior art. It should also be noted that the configuration of the clip 2 insures that some clearance A is always provided between the upper walls 10 of the clip and the surface of the post 32, thereby insuring that the load path is always through the strands 52 rather than through the clip 2.

It is important to note that the electrical performance of the termination is derived by the association of the intimate contact and normal force applied by the clip 2. The mechanics of the clip itself, other than the application of the normal force, have insignificant contribution to the electrical performance of the termination. Therefore, the configuration of the clip 2 insures, that irrespective of dimensional changes during use, the direction of the normal force creating the termination is maintained.

Another benefit of the present invention is derived from the configuration of the conductor receiving section 4. The conductor receiving section is designed to control the strand deformation of the conductor 30. This controlled deformation allows the behavior of the strands 52 to be predicted, thereby allowing the contact area to be optimized and the contact pressure to be maximized. The compound taper of conductor receiving section 4 forms the strand 52 into a dual plane wedge, as illustrated in FIG. 3, which locks the strands in the design shape and ensures that no relative slippage between the strands and the clip occurs during termination. It should be noted that the deformation of the strands 52 cause inter-strand contact forces. However, these forces serve to maintain termination integrity, as the forces cause arcuate bottom walls 14 to resiliently deform accordingly.

As the strands 52 are deformed, respective surfaces of the strands are flattened as they engage other strands, or as they engage the post 32 or the clip 2. Also as the strands 52 are deformed, the movement of the strands causes an abrasion to occur. This surface deformation and abrasion serve to remove the surfaces oxides, thereby enhancing an optimum gastight joint.

The configuration of the conductor receiving section 4 also serves to distribute the stress more uniformly over the strands 52 as they leave the termination zone. In particular, the configuration of the channel 24 proximate opening 18 prevents changes in surface stress and hence endeavors to eliminate strand breakage, thereby reducing the need for more conventional strain relief means.

Changes in construction will occur to those skilled in the art and various apparently different modifications and embodiments may be made without departing from the scope of the invention. The matter set forth in the foregoing description and accompanying drawings is offered by way of illustration only.

We claim:

1. A terminal clip for holding a conductor against, and in electrical contact with a terminal post, the terminal clip having a conductor receiving section and mounting sections, the terminal clip being characterized in that:

the conductor receiving section has an elongated channel provided therein for compressively applying pressure against said conductor lying therewithin, the channel has a uniformly decreasing cross-section configuration along the full length thereof, the channel cooperates with the conductor to insure that the conductor is precisely positioned in the channel, said channel providing substantially the entire means of the clip for applying pressure against the conductor to press it against the terminal post, the mounting sections have the characteristic of resiliency, where the configuration of which insures that, with the conductor inserted into the channel, the mounting section will deform within its elastic limit;

whereby as the clip is exposed to various environments, the clip will compensate for dimensional variations, and generate an adequate normal force to maintain the conductor and the post in electrical engagement.

2. A terminal clip as recited in claim 1 characterized in that the mounting sections have an arcuate configuration which extend from the conductor receiving section, free ends of the mounting sections cooperate with the terminal post to retain the terminal clip in engagement with the terminal post.

3. A terminal clip as recited in claim 1 characterized in that the conductor receiving section has an engagement portion which cooperates with the conductor to supply the normal force to insure that the conductor is maintained in electrical engagement with the post.

4. A terminal clip as recited in claim 3 characterized in that the engagement portion has a top wall and side walls, the top wall is tapered such that the width of the channel provided between the top wall and side walls is smaller proximate a second end of the terminal clip.

5. A terminal clip as recited in claim 3 characterized in that the engagement portion has a top wall and side walls, the side walls are tapered such that the height of the channel is larger proximate a second end of the terminal clip.

6. A terminal clip as recited in claim 4 characterized in that the side walls are tapered such that the height of the channel is larger proximate the second end of the terminal clip.

7. A terminal clip as recited in claim 6 characterized in that an opening is provided proximate a first end of the terminal clip, the opening extends to proximate the engagement portion.

8. A terminal clip as recited in claim 7 characterized in that the engagement portion extends from the second end of the terminal clip toward the first end, the engagement portion extends for approximately half the length of the terminal clip.

* * * * *